United States Patent [19]

Kamata

[11] Patent Number: 5,058,212

[45] Date of Patent: Oct. 22, 1991

[54] HELMET FOR RIDING VEHICLE

[75] Inventor: Eitaro Kamata, Tokyo, Japan

[73] Assignee: Shoei Kako Kabushiki Kaisha, Tokyo, Japan

[21] Appl. No.: 628,048

[22] Filed: Dec. 17, 1990

[30] Foreign Application Priority Data

Sep. 14, 1990 [JP] Japan ..... 2-244875

[51] Int. Cl.[5] ..... A42B 1/08

[52] U.S. Cl. ..... 2/424; 2/171.3

[58] Field of Search ..... 2/410, 424, 425, 171.3, 2/6

[56] References Cited

U.S. PATENT DOCUMENTS

| | | | |
|---|---|---|---|
| 4,514,864 | 5/1985 | Huber | 2/424 |
| 4,519,099 | 5/1985 | Kamiya et al. | 2/424 |
| 4,524,465 | 6/1985 | Huber | 2/424 |
| 4,538,303 | 9/1985 | Schnitzler | 2/424 |
| 4,612,675 | 9/1986 | Broersma | 2/424 |
| 4,615,052 | 10/1986 | Nava | 2/424 |
| 4,667,348 | 5/1987 | Sundahl | 2/410 |
| 4,698,856 | 10/1987 | Arai | 2/425 |
| 4,704,746 | 11/1987 | Nava | 2/424 |
| 4,731,885 | 3/1988 | Nava | 2/424 |

FOREIGN PATENT DOCUMENTS

| | | | |
|---|---|---|---|
| 135812 | 4/1985 | European Pat. Off. | 2/424 |
| 268549 | 5/1988 | European Pat. Off. | 2/410 |
| 3607223 | 7/1987 | Fed. Rep. of Germany | 2/424 |

*Primary Examiner*—Werner H. Schroeder
*Assistant Examiner*—Michael A. Neas
*Attorney, Agent, or Firm*—Armstrong, Nikaido, Marmelstein, Kubovcik & Murray

[57] ABSTRACT

A helmet for riding a vehicle having a distribution chamber provided in a chin cover portion, an air intake hole for introducing a travelling wind to the distribution chamber, and a plurality of jet holes for blowing out the air of the distribution chamber toward an inner surface of a shield plate. The helmet also includes an air introducing member attached to the upper edge of the window opening. The air introducing member is provided at a lower surface thereof with a plurality of guide grooves formed rearwardly, and an outlet disposed at the rear end of the guide grooves and opened toward the shield plate to communicate with a ventilation passage in the cap body. Rising air along the inner surface of the shield plate is reliably formed to effectively prevent a fog of the inner surface of the shield plate.

4 Claims, 4 Drawing Sheets

HELMET FOR RIDING VEHICLE

BACKGROUND OF THE INVENTION

1. Field of the Invention

The present invention relates to a helmet for riding a vehicle used by a rider of a motorcycle or the like and, more particularly, to an improvement in a helmet for riding a vehicle. The improvement is in a helmet which comprises a cap body which is formed of a shell with a buffer liner fitted therein and which includes a chin cover portion located directly below a window opening, and a shield plate attached to the cap body for closing the window opening. The chin cover portion comprises a distribution chamber, an air intake hole for introducing a travelling wind into the distribution chamber, and a plurality of jet holes for blowing out the air in the distribution chamber toward an inner surface of the shield plate, thereby preventing fog of the inner surface of the shield plate.

2. Description of the Prior Art

There is conventionally known a helmet of this type, for example, as disclosed in Japanese Utility Model Laid-Open No. 63-159507.

Heretofore, in order to prevent a fog on an inner surface of a shield plate in the helmet of this type, air is merely blown from the jet holes of a chin cover portion against the inner surface of the shield plate. However, with only this arrangement, it is difficult to generate a rising air along the inner surface of the shield plate, and it is difficult to prevent a fog over a wide range of the inner surface of the shield plate.

SUMMARY OF THE INVENTION

The present invention has been accomplished with such circumstances in view. It is an object of the present invention to provide a helmet of the type described above, in which a rising air along an inner surface of a shield plate is reliably generated thereby to prevent a fog of the inner surface of the shield plate over a wide range.

To accomplish the above object, the present invention provides a helmet wherein the cap body further comprises an air introducing member covering the buffer liner at an upper edge of the window opening, the air introducing member being provided at a lower surface thereof with a plurality of guide grooves formed deeper in a rearward direction and with outlets disposed at rear ends of the guide grooves and opened toward the shield plate to communicate with a ventilation passage in the cap body.

With such a construction, a travelling wind introduced from the air intake holes of the chin cover portion into the distribution chamber is blown from a plurality of jet holes against the inner surface of the shield plate. On the other hand, since the plurality of guide grooves of the duct member provided on the upper edge of the window opening are opened at the outlets of the rear ends of the guide grooves toward the shield plate, air stream directed toward the outlet is easily generated thereby to promote the air blown against the inner surface of the shield plate to rise along the inner surface of the shield plate. Thus, the air stream rising along the inner surface of the shield plate is generated.

These and other objects and features of the present invention will become apparent from the following detailed description in conjunction with the attached drawings.

BRIEF DESCRIPTION OF THE DRAWINGS

The drawings illustrate one embodiment of the present invention, wherein.

DESCRIPTION OF THE PREFERRED EMBODIMENT

The present invention will now be described by way of embodiment with reference to the accompanying drawings.

Figure 1:
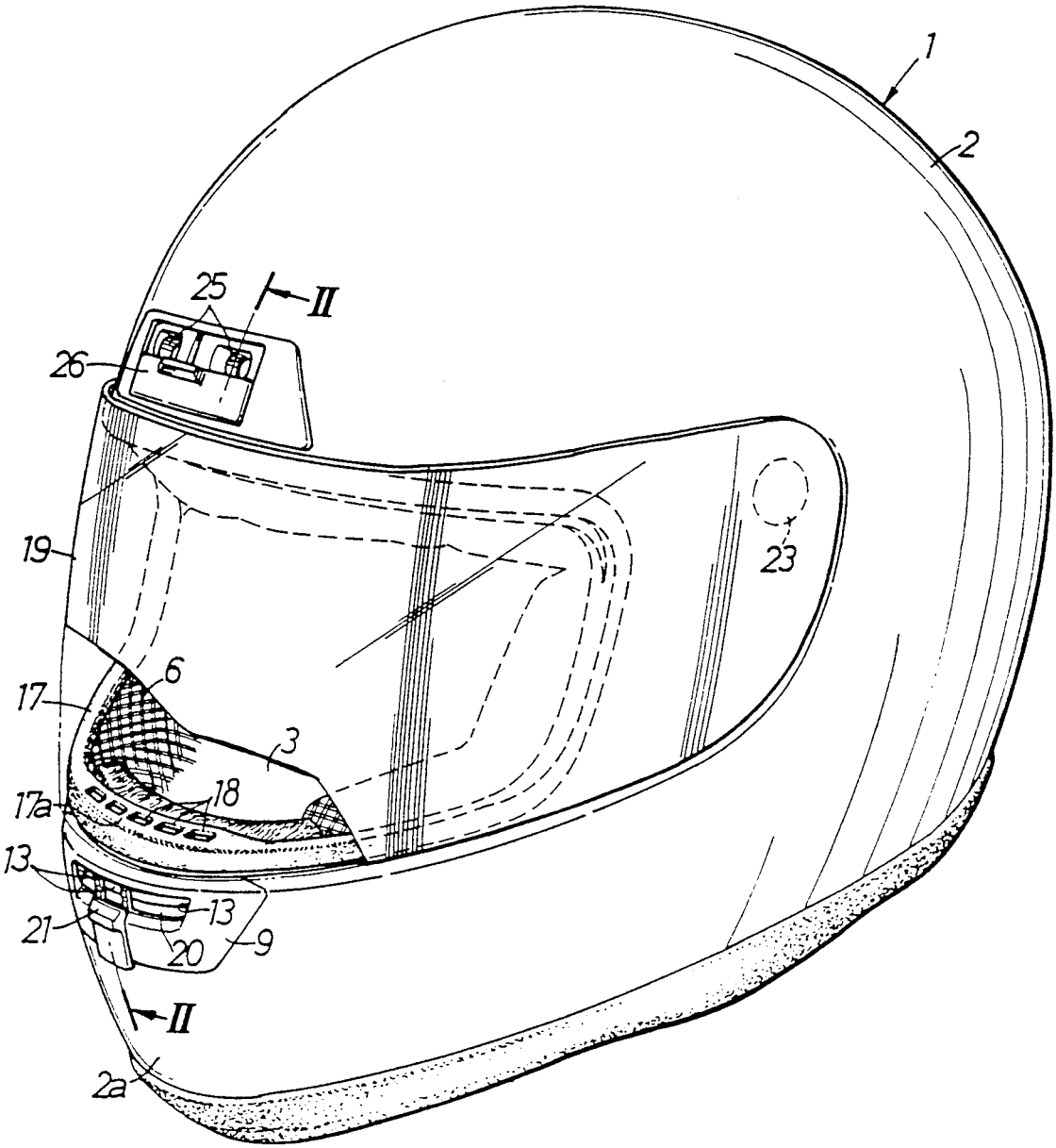
FIG. 1 is a perspective view of a full-face type helmet.
Figure 2:
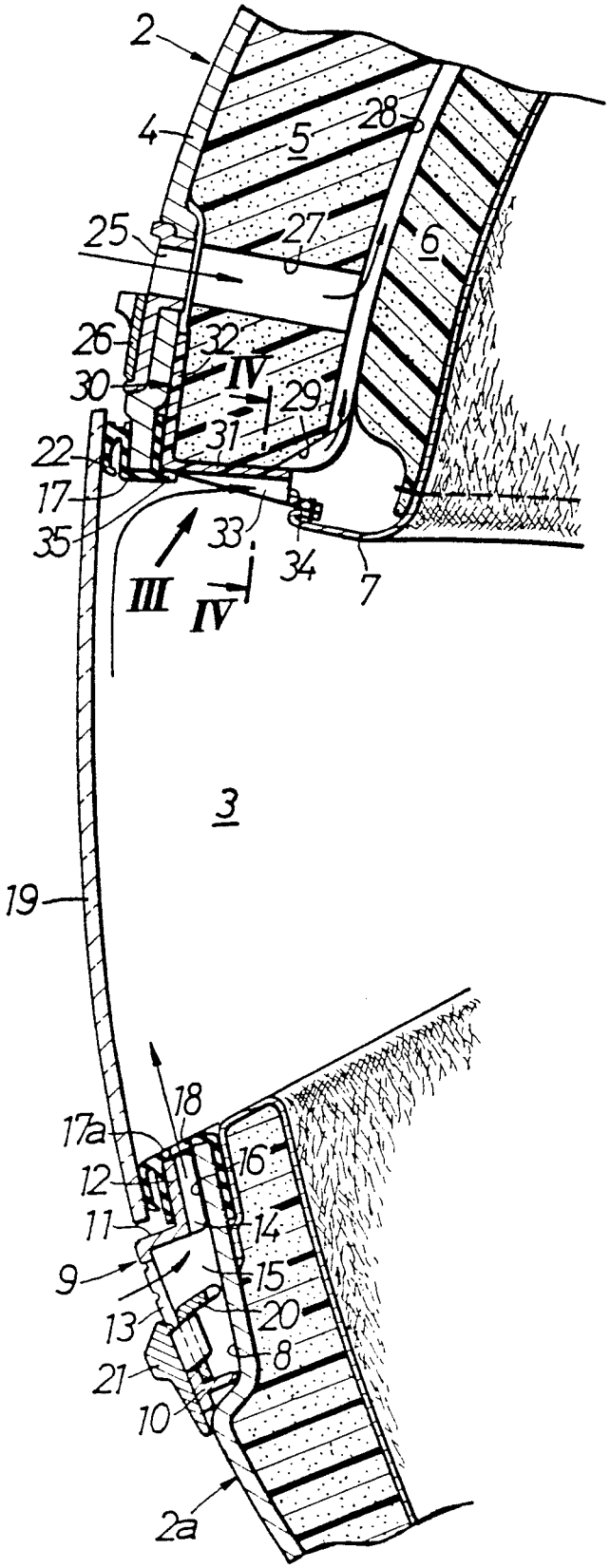
FIG. 2 is a sectional view taken along a line II—II in FIG. 1.

Referring to FIGS. 1 and 2, a cap body 2 of a helmet 1 is composed in a full-face type having a chin cover portion 2*a* directly below a window opening 3 of a front surface.

The cap body 2 is comprised of a shell 4 made of FRP (fiber reinforced plastic), and a buffer liner 5 made of foamed polystyrene mounted on an inner surface of the shell 4. An inner pad 6 made of urethane foam is disposed on an inner surface of the buffer liner 5 excluding a center of the chin cover portion 2*a*. The inner pad 6 is covered with a cloth cover 7.

A recess 8 is formed at a central front surface of the chin cover portion 2*a* from an upper edge to an intermediate portion thereof, and a housing 9 made of synthetic resin is secured by a suitable securing member (not shown) to the shell 4 to cover the recess 8 from its front surface.

The housing 9 is comprising a main body wall 10 which is flush with an outer surface of the shell 4 below the recess 8, a stepped portion 11 rearwardly bent from an upper end of the main body wall 10, and a retreated wall 12 rising from a rear end of the stepped portion 11 to direct to the window opening 3. A plurality of lower air intake holes 13 are provided in the main body wall 10, and a plurality of vertically extended partition walls 14 (one of which is shown in FIG. 2) are projected on inner surfaces of the retreated wall 12.

The main body wall 10 defines, between a bottom surface of the recess 8, a distribution chamber 15 to which the lower air intake holes 13 are opened. And the retreated wall 12 defines, between the bottom of the recess 8 in cooperation with the plurality of partition walls 14, a plurality of air introducing ducts 16 extending from the distribution chamber 15 upwardly.

A channel-shaped edge member 17 made of rubber is adhesively fitted to a peripheral edge of the window opening 3 of the shell 4. The edge member 17 has a wide portion 17*a* extended longitudinally at a lower center thereof, and jet holes 18 of the same number as the air introducing ducts 16 are formed at the upper wall of the wide portion 17*a*.

The wide portion 17*a* is adhesively fitted to the retreated wall 12 of the housing 9 together with the peripheral edge of the window opening 3 of the shell 3. In this case, the jet holes 18 coincide with the ducts 16 so that the air can be blown against the inner surface of a shield plate 19 which will be described later.

A shutter 20 is vertically movably disposed in the distribution chamber 15. A knob 21 is attached to a front surface of the shutter 20 for vertically sliding the shutter 20 on an outer surface of the housing 9. If the knob 21 is slid upwardly, all the lower air intake holes 13 are simultaneously closed by the shutter 20, whereas if the knob 21 is slid downwardly, all the air intake holes 13 are simultaneously opened.

A seal lip 22 is integrally formed on the front surface of the edge member 17. The transparent shield plate 19 is mounted at opposite ends thereof to left and right opposite side walls of the cap body 2 through pivot sections 23. The shield plate 19 closes the window opening 3 by tightly contacting the inner surface of the plate 19 with the seal lip 22. If the shield plate 19 is turned upwardly around the pivot sections 23, the window opening 3 can be opened.

A plurality of upper air intake holes 25 are opened in a front wall of the shell 4 directly above the window opening 3, and a vertical slid type shutter 26 for opening and closing the upper air intake holes 25 is provided. The buffer liner 5 is composed of a plurality of vent holes 27 (one of which is shown in FIG. 2) communicating with the upper air intake holes 25, respectively, a plurality of ventilation grooves 28 (one of which is shown in FIG. 2) as ventilation passages extended longitudinally on an inner surface of the liner 5 in communication with the vent holes 27, respectively, and a notch 29 formed on the inner corner of the liner 5 on the upper edge region of the window opening 3. The front ends of the ventilation grooves 28 are opened to the notch 29, and the rear ends communicate with a discharge port which is not shown (See the Japanese Patent Laid-Open No. 63-159507, for example) opened to a rear surface of the cap body 2 as shown.

Figure 3:
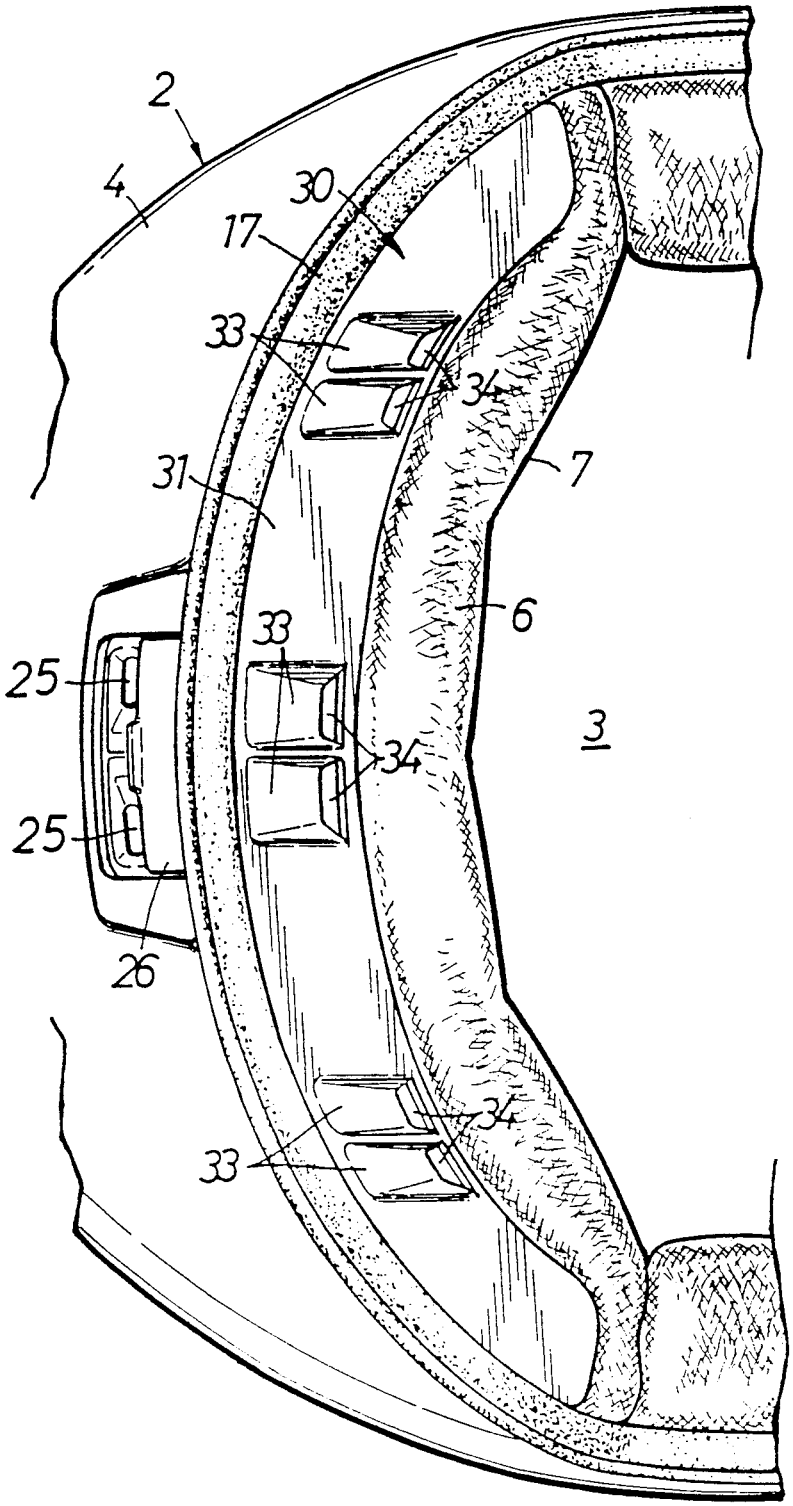
FIG. 3 is a view as seen from an arrow III of FIG. 2.
Figure 4:
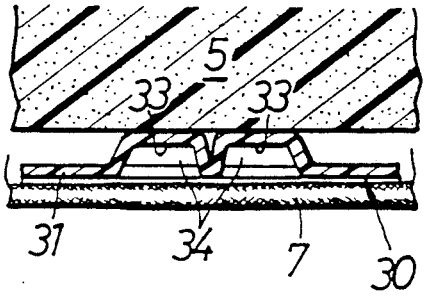
FIG. 4 is a sectional view taken along the line IV—IV of FIG. 2.

Referring to FIGS. 2 to 4, an air introducing member 30 made of synthetic resin and facing the upper edge of the window opening 3 is attached to the buffer liner 5. More specifically, the air introducing member 30 is comprised of a horizontal plate portion 31 and a vertical plate portion 32 raising from the front end of the horizontal plate portion 31. The vertical plate portion 32 is adhered to the front surface of the buffer liner 5 at the rear side of the shell 4 in a state where the horizontal plate portion 31 is superposed on the buffer liner 5 at the upper edge of the window opening 3.

A plurality of guide grooves 33 extending from the front end to a position short of the rear end of the horizontal plate portion 31 are provided on a lower surface of the horizontal plate portion 31 in parallel along the upper edge of the window opening 3. These guide grooves 33 are formed deeper toward the rear ends, and outlets 34 opened to the shield plate 19 are provided at the rear ends of the guide grooves 33. The outlets 34 communicate with the notch 29 of the buffer liner 5.

The front end of the skin 7 of the inner pad 6 is sewed to the horizontal plate for covering a rear end thereof. A flange 35 is formed at the edge member 17 to cover the front end of the horizontal plate portion 31. Thus, the air introducing member 30 is bordered with the edge member 17 and the inner pad 6 to be made neat in its external appearance.

Description will now be made of the operation of this embodiment.

When a rider wearing a helmet 1 leaves the upper shutter 20 open at the time of travelling on a motorcycle in a state that the window opening 3 is closed by the shield plate 19, a travelling wind enters the distribution chamber 15 from the air intake holes 13 and is branched into the plurality of air introducing ducts 16 extending from the chamber 15 upwardly, and the air is blown out from corresponding jet holes 18 toward the inner surface of the shield plate 19.

On the other hand, since negative pressure generated behind the cap body 2 is acted at the discharge port connected to the rear ends of the ventilation grooves 28 in the cap body 2, a rearward air stream is generated in the ventilation grooves 28. Thus, a substantially horizontal air stream directed toward the outlet 34 is also generated in the guide grooves 33 of the air introducing member 30.

As a result, the air blown out from the jet holes 18 is drawn into the air stream and raised along the inner surface of the shield plate 19, and is flowed rearwardly in the vicinity of the upper edge of the window opening 3, and blown out into the guide passage 33, the outlet 34, the notch 29 and the ventilation grooves 28.

In this manner, the air blown out from the jet holes 18 is formed in a rising air stream along the inner surface of the shield plate 18 to effectively prevent a fog of the inner surface of the shield plate 18.

If the shutter 26 is left open, the travelling wind is also introduced into the upper air intake holes 25 to flow through the vent holes 27 into the ventilation grooves 29, thereby promoting the ventilation in the cap body 2.

What is claimed is:

1. A helmet for riding a vehicle comprising a cap body which is formed of a shell with a buffer liner fitted therein and which includes a chin cover portion located directly below a window opening, and a shield plate attached to said cap body for closing the window opening, said chin cover portion comprising a distribution chamber, an air intake hole for introducing a travelling wind into the distribution chamber, and a plurality of jet holes for blowing out the air in said distribution chamber toward an inner surface of said shield plate, wherein said cap body further comprises an air introducing member covering said buffer liner at an upper edge of the window opening, said air introducing member being provided at a lower surface thereof with a plurality of guide grooves formed in a rearward direction and with outlets disposed at rear ends of said guide grooves and opened toward the shield plate to communicate with a ventilation passage in said cap body.

2. A helmet for riding a vehicle according to claim 1, wherein said air introducing member further includes a horizontal plate portion which is provided with said guide grooves and said outlets and which is superposed on said buffer liner at the upper edge of the window opening and a vertical plate portion raised from a front end of said horizontal plate portion and held between said shell and said buffer liner, and wherein a flange for covering the front end of said horizontal plate portion is formed at an edge member which is fitted to a peripheral edge of the window opening of said shell.

3. A helmet for riding a vehicle according to claim 1, wherein said ventilation passage is a groove extended longitudinally of the cap body in an inner surface of said buffer liner, and a front end of the groove is opened to a notch extended in an inner corner of said buffer liner at an upper edge region of the window opening so as to communicate with the outlets.

4. A helmet for riding a vehicle according to claim 3, wherein a cover for covering an inner pad disposed on the inner surface of said buffer liner is connected to the rear end of said air introducing member to permit air to flow between said cover and said notch.

* * * * *